US006599467B1

(12) United States Patent
Yamaguchi et al.

(10) Patent No.: US 6,599,467 B1
(45) Date of Patent: Jul. 29, 2003

(54) PROCESS FOR FORGING TITANIUM-BASED MATERIAL, PROCESS FOR PRODUCING ENGINE VALVE, AND ENGINE VALVE

(75) Inventors: Toshiya Yamaguchi, Nishikamo-gun (JP); Akio Hotta, Toyota (JP); Yoshinori Shibata, Nagoya (JP); Tadahiko Furuta, Aichi-ken (JP); Takashi Saito, Aichi-ken (JP); Satoru Iwase, Gamagori (JP); Takashi Haruta, Nagoya (JP); Tatsuya Kitamura, Obu (JP)

(73) Assignees: Toyota Jidosha Kabushiki Kaisha, Toyota (JP); Aisan Kogyo Kabushiki Kaisha, Obu (JP)

( * ) Notice: Subject to any disclaimer, the term of this patent is extended or adjusted under 35 U.S.C. 154(b) by 0 days.

(21) Appl. No.: 09/418,753

(22) Filed: Oct. 15, 1999

(30) Foreign Application Priority Data

Oct. 29, 1998 (JP) ..... 10-309234

(51) Int. Cl.[7] ..... B22F 3/20; B22F 3/24
(52) U.S. Cl. ..... 419/28; 419/29; 75/245
(58) Field of Search ..... 419/28, 29; 75/245

(56) References Cited

U.S. PATENT DOCUMENTS

| | | | | | |
|---|---|---|---|---|---|
| 3,795,970 | A | * | 3/1974 | Keathley et al. | 29/423 |
| 4,073,474 | A | * | 2/1978 | Hashimoto et al. | 251/368 |
| 4,619,699 | A | * | 10/1986 | Petkovic-Luton et al. | 75/252 |
| 4,639,281 | A | * | 1/1987 | Sastry et al. | 148/407 |
| 4,647,304 | A | * | 3/1987 | Petkovic-Luton et al. | 75/0.5 R |
| 4,675,964 | A | | 6/1987 | Allison | |
| 4,729,546 | A | | 3/1988 | Allison | |
| 4,731,115 | A | * | 3/1988 | Abkowitz et al. | 75/236 |
| 4,852,531 | A | * | 8/1989 | Abkowitz et al. | 123/188 AA |
| 5,112,415 | A | * | 5/1992 | Mae | 18/421 |
| 5,217,816 | A | * | 6/1993 | Brupbacher et al. | 428/614 |
| 5,517,956 | A | * | 5/1996 | Jette et al. | 123/188.3 |
| 5,662,745 | A | * | 9/1997 | Takayama et al. | 148/237 |
| 5,951,789 | A | * | 9/1999 | Ueta et al. | 148/325 |
| 6,387,196 | B1 | * | 5/2002 | Yamaguchi et al. | 148/669 |

FOREIGN PATENT DOCUMENTS

| | | |
|---|---|---|
| JP | 3-36230 | 2/1991 |
| JP | 3-150331 | 6/1991 |
| JP | 6-229213 | 8/1994 |
| JP | A-6-229213 | 8/1994 |
| JP | A-7-34815 | 2/1995 |
| JP | 7-62407 | 3/1995 |
| JP | 7-90414 | 4/1995 |
| JP | 8-10850 | 1/1996 |
| JP | 8-33920 | 2/1996 |
| JP | 8-61025 | 3/1996 |
| JP | 8-267144 | 10/1996 |
| JP | A-10-128486 | 5/1998 |
| JP | 10-251778 | 9/1998 |

* cited by examiner

*Primary Examiner*—Daniel J. Jenkins
(74) *Attorney, Agent, or Firm*—Oliff & Berridge, PLC

(57) ABSTRACT

The invention provides a process for forging a titanium-based material comprises the steps of: preparing a titanium-based sintered workpiece including at least one of ceramics particles and pores in a total amount of 1% or more by volume, the ceramics particles being thermodynamically stable in a titanium alloy; and heating the workpiece to a forging temperature and forging the same. In the production process, the pores or the ceramics particles inhibit the grain growth during forging. Accordingly, it is possible to carry out the forging at a relatively high temperature at which the titanium-based material exhibits a small resistance to deformation. Moreover, the titanium-based material can maintain an appropriate microstructure even after the forging. Consequently, the impact value and the fatigue strength are inhibited from decreasing.

7 Claims, 3 Drawing Sheets

RELATIONSHIPS BETWEEN RELATIVE DENSITIES AND HIGH-TEMP. ELONGATION
COMPOSITION OF MATRIX:
Ti-5.9Al-3.9Sn-3.9Zr-1Mo-1Nb-0.15Si
TITANIUM BORIDE PARTICLES:
5% BY VOLUME (a)

(b)

(c)

PROCESS FOR FORGING TITANIUM-BASED MATERIAL, PROCESS FOR PRODUCING ENGINE VALVE, AND ENGINE VALVE

BACKGROUND OF THE INVENTION

1. Field of the Invention

The present invention relates to a process for forging a titanium-based material. More particularly, it relates to a process for forging a titanium-based alloy, process which is used to make an automobile engine valve.

2. Description of the Related Art

The requirements for the materials of engine valves, which are installed to automobile combustion engines, are classified as the most severest ones in the engine component parts. In particular, the engine valves are subjected to considerably large loads while they are exposed to high-temperature combustion atmospheres. Accordingly, the engine valves are required to exhibit a heat resistance, a corrosion resistance, an oxidation resistance, and a wear resistance against the seating surfaces of the seats at elevated temperatures. Moreover, as the recent trend toward high-performance automobiles develops, the engine valves are required to be lightweighted.

As an engine valve satisfying these requirements, an engine valve is developed which uses a titanium-based material (or a titanium alloy).

In the titanium alloy, the characteristics are closely related to the crystal structures. Therefore, the titanium alloy is roughly divided into an α-titanium alloy, an α+β-titanium alloy and a β-titanium alloy according to the crystal structures.

It has been known that the α+β-titanium alloy, which is used in the largest amount, transforms to a β phase at a transformation temperature ( β-transus temperature) or more ( β phase region), and that the titanium alloy having the β phase transforms to an α+β-structure at the β-transus temperature or less (α+β phase region).

The α+β-titanium alloy is rapidly turned into a coarse microstructure when the β-transus temperature is exceeded, and exhibits a decreased impact value and a reduced fatigue strength. Accordingly, the forging of the conventional α+β-titanium alloy is carried out in the α+β phase region. However, since the α+β-titanium alloy exhibits a large resistance to deformation in the α+β phase region, it is difficult to carry out the forging.

The titanium alloy engine valve, which is processed out of such a titanium alloy, is generally manufactured in the following manner. A titanium alloy rod material is manufactured from an ingot titanium alloy, and is molded preliminarily by an upsetter. The upset portion is hot swaged so as to form a valve shape.

For example, Japanese Unexamined Patent Publication (KOKAI) No. 7-34,815 discloses a process for producing a titanium alloy engine valve. In this production process, a titanium alloy rod is hot extruded, and is swaged with a mold to an umbrella-like shape at the end.

Another a process is for manufacturing an engine valve by the powder metallurgy method. Namely, a titanium alloy powder is compacted to a molded substance having a valve shape by the cold isostatic pressing (CIP), and thereafter the compact having a valve shape is sintered.

As an example of such a powder metallurgy method, a process for producing an engine valve is disclosed in Japanese Unexamined Patent Publication (KOKAI) No. 6-229,213. In the publication, there is disclosed the following process for producing an engine valve. Namely, a mixture of a titanium powder and an aluminum powder is subjected to the canning so that it is extruded and forged into a valve shape, and is thereafter reacted to synthesize Ti—Al intermetallic compounds, thereby producing an engine valve comprising the Ti—Al intermetallic compounds.

However, in the process for producing an engine valve set forth in Japanese Unexamined Patent Publication (KOKAI) No. 7-34,815, the titanium alloy rod material is used. Since the titanium alloy rod material is a cast material, it is necessary to provide a large number of processes for manufacturing the rod material and for turning it into a straight rod shape. In addition, since the material yield is bad, and accordingly the cost goes up.

In the production process for producing an engine valve set forth in Japanese Unexamined Patent Publication (KOKAI) No. 6-229,213, the powder metallurgy method is used. Since the as-sintered body has many residual pores, the resulting engine valve has a problem in that it exhibits the low ductility and fatigue strength.

SUMMARY OF THE INVENTION

The present invention has been developed in view of the aforementioned circumstances. It is therefore an object of the present invention to provide a process for forging a titanium-based material, process which can produce titanium-based material products of high ductility and fatigue strength at a low cost, and to provide a process for producing an engine valve.

In order to achieve the aforementioned object, the inventors of the present invention investigated into the processes for producing titanium-based materials. As a result, it was possible to carry out forging under a temperature condition where a material exhibited less resistance to deformation and to keep a fine alloy structure by hot forging a titanium-based sintered workpiece which included ceramics, which were thermodynamically stable in a titanium alloy, or pores. Accordingly, it was confirmed that the impact value and the fatigue strength were inhibited from decreasing. Thus, the inventors discovered that the aforementioned problems could be overcome.

Namely, a process for forging a titanium-based material according to the present invention is characterized in that it comprises the steps of:

preparing a titanium-based sintered workpiece including at least one of ceramics particles and pores in a total amount of 1% or more by volume, the ceramics particles being thermodynamically stable in a titanium alloy; and heating the workpiece to a forging temperature and forging the same.

The ceramics particles which are thermodynamically stable in a titanium alloy can be titanium boride, titanium carbide, titanium silicide, and titanium nitride. The titanium boride can be TiB and $TiB_2$. The titanium carbide can be TiC and $Ti_2C$. The titanium nitride can be TiN. In a wider sense, the ceramics particles include intermetallic compounds and oxides of rare-earth elements as well. Among them, the titanium boride is preferred. The phrase, "thermodynamically stable in a titanium alloy", means that the ceramics particles can exist as particles and reside in a titanium alloy without decomposing and solving therein up to elevated temperatures. It does not necessarily mean that the ceramics particles require a heat resistance strength. As far as the ceramics particles exist as particles, they operate and effect advantages similarly. The ceramics particles can preferably have an average particle diameter of from 1 to 40 μm.

A process for producing an engine valve according to the present invention is characterized in that it comprises the steps of:

heating a sintered billet;

extruding the heated billet with a part thereof unextruded, thereby forming a stem;

rolling the extruded stem, thereby correcting an axial flexure thereof;

re-heating the sintered billet; and hot upsetting the unextruded part, thereby forming a head.

When the titanium-based material is simply sintered, it suffers from the degradation in terms of the ductility and the fatigue strength by the residing pores. However, since compacting is carried out by forging, no degradation of the ductility and the fatigue strength occurs.

In the present titanium-based material production process, since the sintered body forged, the degradation of the ductility and the fatigue strength resulting from the residing pores can be suppressed. Thus, the present titanium-based material production process can produce forged products whose characteristics are equal to those of ingot metal.

Moreover, in the present engine valve production process, since the sintered billet is used, the processes up to the manufacturing of the billet are shortened remarkably.

BRIEF DESCRIPTION OF THE DRAWINGS

A more complete appreciation of the present invention and many of its advantages will be readily obtained as the same becomes better understood by reference to the following detailed description when considered in connection with the accompanying drawings and detailed specification, all of which forms a part of the disclosure.

DETAILED DESCRIPTION OF THE PREFERRED EMBODIMENTS

Having generally described the present invention, a further understanding can be obtained by reference to the specific preferred embodiments which are provided herein for the purpose of illustration only and not intended to limit the scope of the appended claims.

(On Process for Forging Titanium-based Material)

The present titanium-base material forging process comprises the steps of preparing a sintered workpiece; heating the sintered workpiece; and forging the sintered workpiece.

The step of preparing a sintered workpiece is a step of making a sintered workpiece by sintering a raw material powder. Here, the sintered workpiece can be obtained in the following manner. A titanium-based powder having a predetermined composition is fully mixed, and is compacted into a molded substance by using a mold. The resulting green compact is sintered.

The raw material powder can be a mixture powder including a titanium-based powder and a reinforcement powder, and a titanium-based powder. The titanium-based powder can be a pure titanium powder and a titanium hydride powder. The reinforcement powder can be a master alloy powder, such as an Al—V alloy powder and an Al—Sn—Zr—Mo—Nb—Si alloy powder, or a ceramics powder, such as $TiB_2$ and TiC. The titanium-based alloy powder can be, for example, a Ti-6Al-4V alloy powder and a Ti-6Al-4V-5TiB alloy powder. Unless otherwise specified, the composition of the metallic component is expressed in % by weight, and the composition of the ceramic particles or the pores is expressed in % by volume.

The titanium-based powder can preferably have an average particle diameter of 80 μm or less, further preferably from 45 μm or less. When the average diameter exceeds 80 μm, the sintering temperature decreases to result in cracks during the forging.

Figure 1:
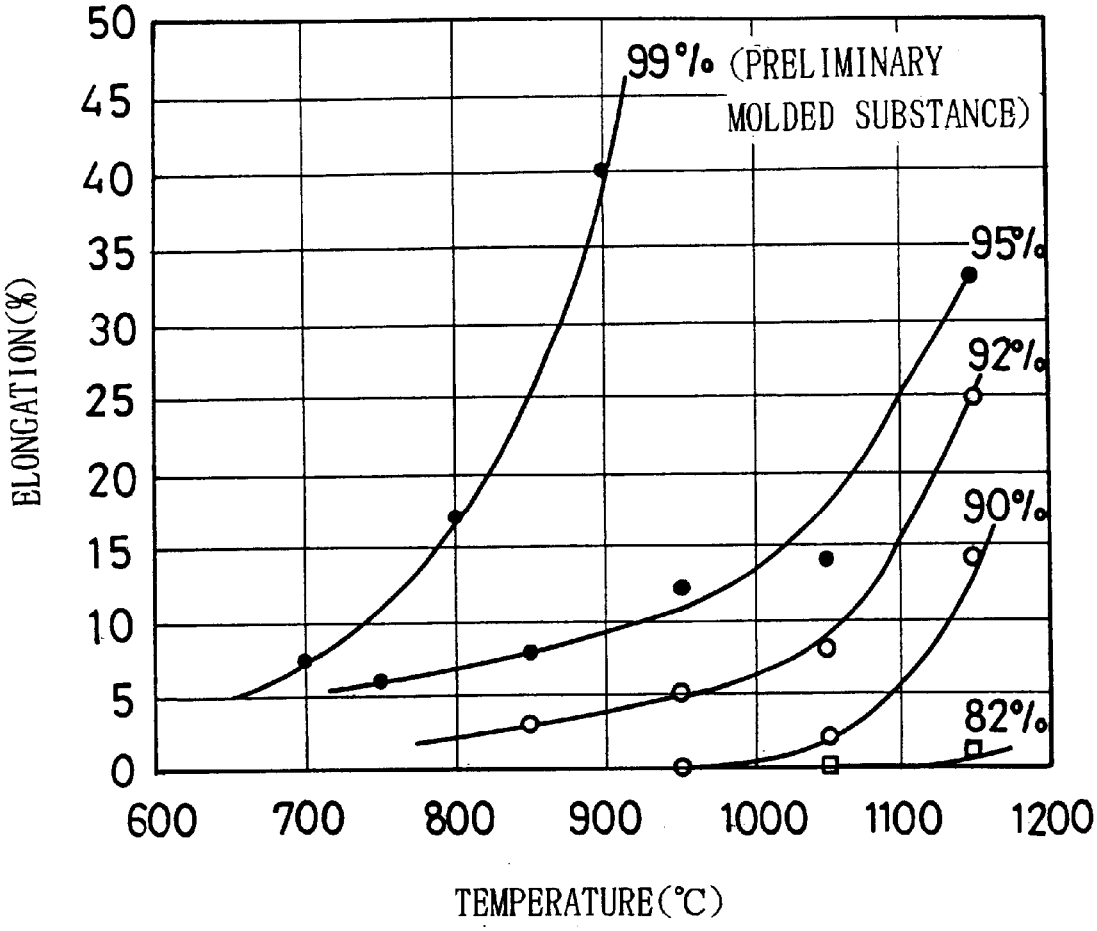
FIG. 1 is a diagram for illustrating the relationships between the relative density and the high-temperature ductility of a titanium-based sintered body.

Since the sintered workpiece is made by compacting a powder followed by sintering, it has pores therein. This sintered workpiece can preferably exhibit a high relative density. When the relative density of the sintered workpiece increases, the elongation at elevated temperatures increases. Accordingly, the forgeability of the sintered workpiece improves during the forging. This is verified by the results of the measurements on the relationships between the relative density and the high-temperature elongation illustrated in FIG. 1. The relationships illustrated in FIG. 1 are obtained by measuring the high-temperature elongation of a titanium-based sintered body while changing the relative density thereof. The titanium alloy sintered substance included Ti-5.9Al-3.9Sn-3.9Zr-1Mo-1Nb-0.15Si alloy matrix in which titanium boride particles were dispersed in an amount of 5% by volume.

The step of heating the sintered workpiece is a step of heating the sintered workpiece to a forging temperature. As can be understood from the relationships shown in FIG. 1, the elongation is improved as the temperature increases. Namely, the elongation increases so that the forgeability is improved. The heating temperature can preferably fall in the range of from 900 to 1,400° C., further preferably from 1,000 to 1,300° C.

The upper limit of the heating temperature can be raised more than the β-transus temperature. Of course, it is possible to heat and forge in the α+β phase region which is lower than the β-transus temperature. However, in the present invention, since the pores residing in the sintered substance or the ceramics particles (e.g., the titanium boride particles) inhibit the grain growth, it is possible to heat and forge in the β phase region. Thus, the forgeable temperature can be enlarged.

The pores can preferably reside in the sintered workpiece in an amount of 1% by volume or more. When the pore ratio is less than 1% by volume, it results in the grain growth. The ceramics particles (e.g., the titanium boride particles) can preferably exist in an amount of 1% by volume or more. However, the total amount combined with the pores can preferably be 1% by volume or more, further preferably from 1 to 5% by volume.

When the heating temperature exceeds the aforementioned heating temperature, the oxidation develops considerably on the surface of the sintered workpiece. However, the oxidation can be avoided by carrying out the forging in an inert gas.

The forging is a processing method in which a metallic material is pressurized with a jig to give the metallic material a plastic deformation and to process it to a predetermined dimensional configuration. The forging method can be the free forging, the mold forging, the extrusion and the upsetting.

In the forging process, it is preferred that the sintered workpiece is flowed in the direction along which the molded product extends. Namely, the flow is carried out in the extending direction of a component part. Thus, the residual pores can be linearized in the tensile stress direction in the surface of the molded product. Hence, it is possible to suppress the degradation of the mechanical characteristics resulting from the residual pores.

When the sintered workpiece includes fiber-shaped or rod-shaped reinforcement particles which are dispersed in the metallic matrix, the reinforcement particles can be oriented in the tensile stress direction in the surface of the molded product. Accordingly, the mechanical characteristics can be improved. Moreover, when the impurities are dispersed similarly, or when the other intervening substances are dispersed, these intervening substances are also oriented in the tensile stress direction. Hence, it is possible to suppress the degradation of the mechanical characteristics.

(On Process for Producing Engine Valve)

The present engine valve production process comprises the steps of heating a sintered billet; forming a stem from a part of the billet; correcting the stem; re-heating the sintered billet; and upsetting a head from the rest of the billet.

The billet is a sintered billet which is made by compacting a raw material powder and followed by sintering.

The step of heating the billet is carried out because the elongation of the billet increases when the billet is heated and because the billet is likely to deform during the forging. In this instance, the heating temperature can preferably fall in the range of from 900 to 1,400° C., further preferably from 1,000 to 1,300° C.

The step of forming a stem to the billet is a step of extruding the heated billet to form a stem. By forming the stem by extruding, the pores or the intervening substances, such as the reinforcement particles, are oriented in the extending direction of the stem. Thus, the mechanical strength of the engine valve is improved.

The step of correcting the stem is a step of hot rolling the thus formed stem immediately. By hot rolling the formed stem immediately, it is possible to correct a material, which exhibits a low elongation at room temperature, such as a heat-resistant Ti alloy, without causing cracks. Moreover, by improving the axial accuracy, it is possible to carry out the upsetting with a high axial accuracy. Concerning a material, which exhibits a high elongation at room temperature, it is possible to carry out the correcting subsequently to cooling the material adjacent to room temperature after forming the stem.

In the step of re-heating, the sintered billet is re-heated so that it is likely to deform, because the rolling temperature at the correction of the stem is decreased to a temperature lower than the temperature preferable to the forging. The sintered billet can preferably be re-heated at a temperature of from 900 to 1,400° C.

The step of upsetting the head is a step of hot upsetting the head. In this step, the upsetting is carried out with a high axial accuracy since the stem has been corrected. The clearance can be reduced between the inside diameter of the through hole, which is provided for an upsetting die to adjust the stem, and the outside diameter of the workpiece. Thus, the head can be formed with a highly accurate squareness.

The present invention will be hereinafter described with reference to specific examples.

EXAMPLE NO. 1

A hydride-dehydride titanium powder (under 100 mesh), an Al-40V alloy powder having an average particle diameter of 10 $\mu$m, a $TiB_2$ powder having an average particle diameter of 2 $\mu$m were weighed so that a predetermined composition was established. The powders were mixed fully. After fully mixing the powders, the mixture powder was compacted with a mold to form a cylinder-shaped green compact having a diameter of 16 mm and a length of 45 mm. At this moment, the compacting pressure was 5 t/cm$^2$. Sample Nos. 1, 2, 5 and 6 and Comparative Example Nos. 1, 2, 3 and 4 were green compacts which were made by mixing the Ti powder and the Al-40V alloy powder. Sample Nos. 3, 4, 7 and 8 were green compacts which were made by mixing the $TiB_2$ powder in addition to the Ti powder and the Al-40V alloy powder.

Thereafter, these cylinder-shaped green compacts were heated at 1,300° C. for 4 hours in an atmosphere whose vacuumness was on the order of $10^{-5}$ Torr. Thus, the green compacts were sintered to obtain sintered billets.

The sintered billets were cut at a position by 10 mm from the end surface. The cross-sectional structures were observed with an optical microscope, thereby measuring the size of the old β grains.

The rest of the cut sintered billets were upset at a heating temperature of 1,030° C. or 1,300° C. with an upsetting ratio of 60%. Thereafter, the cross-sectional structures of the swaged substances were observed at the center, thereby measuring the size of the old β grains.

It is apparent from the results shown in Table 1 that, in Sample Nos. 1 through 8, the grain sizes after the forging were inhibited from grain growth by the pores and/or the titanium boride particles.

TABLE 1

| Identification | Porosity (vol. %) | Titanium Boride (vol. %) | Heating Temp. at Forging (° C.) | Old β Grain Size ($\mu$m) Before Forging | After Forging | Remarks |
|---|---|---|---|---|---|---|
| Sample No. 1 | 5 | 0 | 1,030 | 80 | 70 | |
| Sample No. 2 | 1 | 0 | 1,030 | 85 | 75 | |
| Sample No. 3 | 5 | 5 | 1,030 | 60 | 50 | |
| Sample No. 4 | 1 | 5 | 1,030 | 65 | 55 | |
| Comp. Ex. No. 1 | 0.5 | 0 | 1,030 | 100 | 120 | |
| Comp. Ex. No. 2 | 0 | 0 | 1,030 | 150 | 220 | |
| Sample No. 5 | 5 | 0 | 1,300 | 80 | 80 | |
| Sample No. 6 | 1 | 0 | 1,300 | 85 | 84 | |
| Sample No. 7 | 5 | 5 | 1,300 | 60 | 56 | |

TABLE 1-continued

| Identification | Porosity (vol. %) | Titanium Boride (vol. %) | Heating Temp. at Forging (° C.) | Old β Grain Size (μm) Before Forging | After Forging | Remarks |
|---|---|---|---|---|---|---|
| Sample No. 8 | 1 | 5 | 1,300 | 65 | 60 | |
| Comp. Ex. No. 3 | 0.5 | 0 | 1,300 | 100 | 230 | |
| Comp. Ex. No. 4 | 0 | 0 | 1,300 | 150 | 400 | Cracks |

Note (1): Forging means upsetting.
Note (2): Matrix composition was Ti—6Al—4V (weight %).

EXAMPLE NO. 2

As an example of the present titanium-based material forging process and the present engine valve production process, an engine valve comprising a titanium-based material was produced.

(Preparation of Sintered Billet)

A hydride-dehydride titanium powder (under 100 mesh), an Al-24.9Sn-24.4Zr-6.2Nb-6.2Mo-1.4Si alloy powder having an average particle diameter of 10 μm, a $TiB_2$ powder having an average particle diameter of 2 μm were weighed so that a predetermined composition was established. The powders were mixed fully. The mixture powder was compacted with a mold to form a cylinder-shaped green compact having a diameter of 16 mm and a length of 45 mm. At this moment, the compacting pressure was 5 t/cm$^2$.

Figure 2:
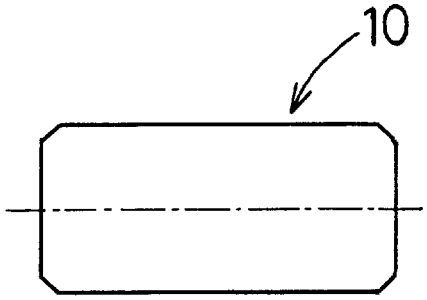
FIGS. 2(*a*), (*b*) and (*c*) are diagrams for illustrating how a sintered billet is forged in the present engine valve production process.
Figure 2:
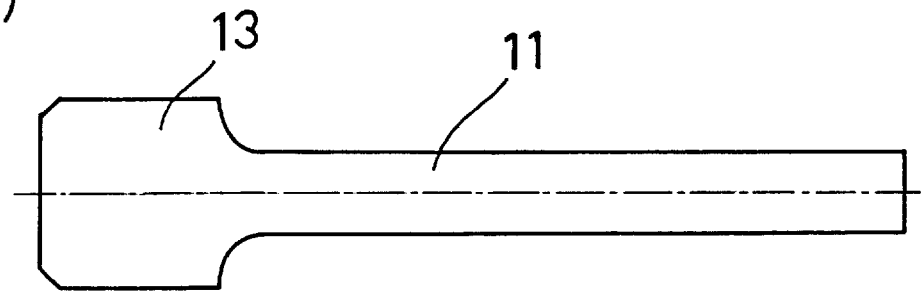
Figure 2:
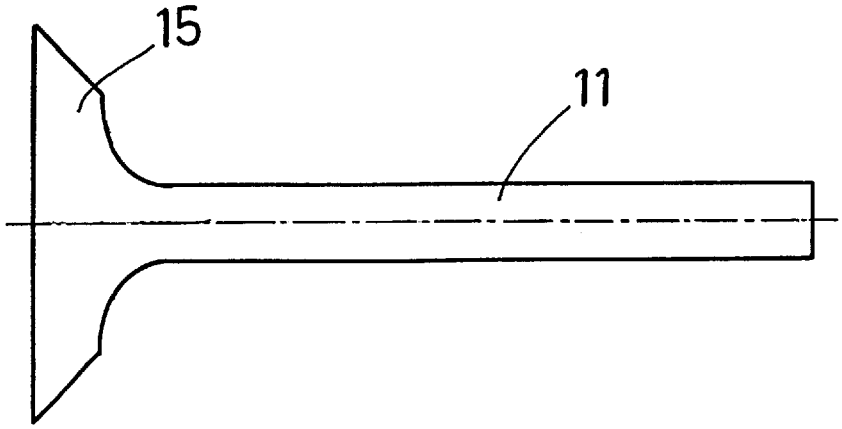

Thereafter, the cylinder-shaped green compact was heated at 1,300° C. for 4 hours in an atmosphere whose vacuumness was on the order of $1.0\times10^{-5}$ Torr. Thus, the green compact was sintered to obtain a sintered billet as illustrated in FIG. 2(*a*). The resulting billet 10 had a relative density of 4.1 g/cm$^3$ (90%).

(Forging)

Figure 3:
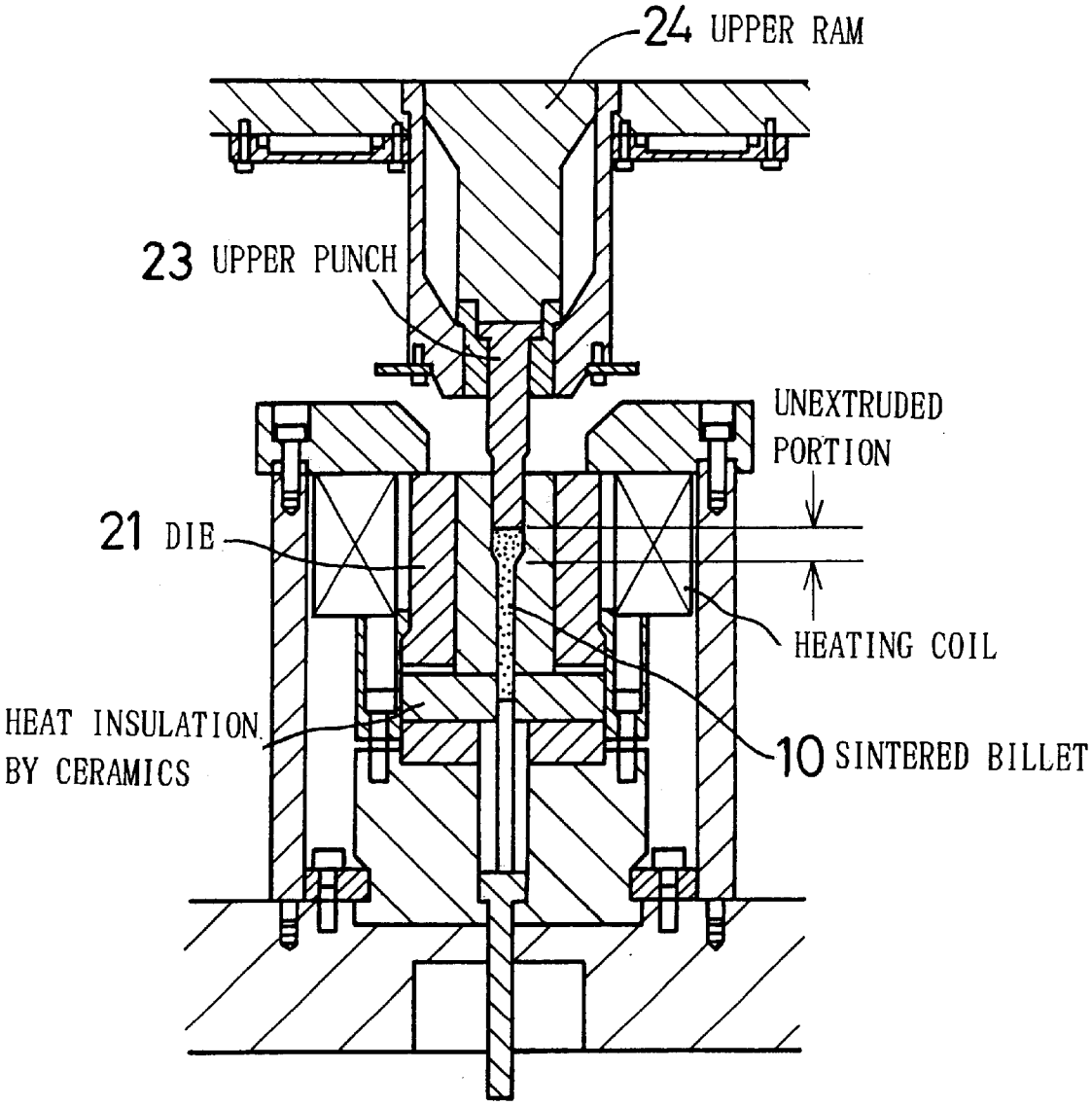
FIG. 3 is a diagram for illustrating a pressing machine which is used in the extrusion molding of the present engine valve production process.

After heating the resulting billet 10 at 1,200° C., an extrusion molding was carried out to form a stem 11 of an engine valve as illustrated in FIG. 2(*b*). The extrusion was carried out by using an extrusion molding machine 2 as illustrated in FIG. 3. During the extrusion molding, the die temperature was set at 450° C. The extrusion ratio was set at 8 in the extrusion molding. The extrusion ratio was set at such a value that the material exhibited a relative density of 95% in the unextruded portion, namely in the portion to be deformed into the head of the valve. When the extrusion ratio decreases, the relative density of the unextruded portion hardly reaches 95%.

The extrusion molding machine 2 was operated in the following manner. An extrusion material (the billet 10) was placed in a die 21, and was pressurized from above by an upper punch 23. Thus, while deforming the extrusion material, the extrusion material was flowed out through the opening of the die 21. The upper punch 23 was disposed under the upper ram 24. Accordingly, the extrusion material was pressurized by descending the upper ram 24.

The billet with the stem of an engine valve formed was hot rolled immediately. During the rolling, the temperature was in the range of from 200 to 500° C.

After carrying out rolling, the billet was heated to a temperature of from 1,250 to 1,350° C., and was placed in a die whose temperature was set in the range of from 400 to 580° C. Then, an upsetting was carried out, thereby forming the unextruded portion 13 into an umbrella-shaped valve head 15 (FIG. 2(*c*)). Note that the forging temperature was decreased less than the heating temperature by 100 to 180° C.

Figure 4:
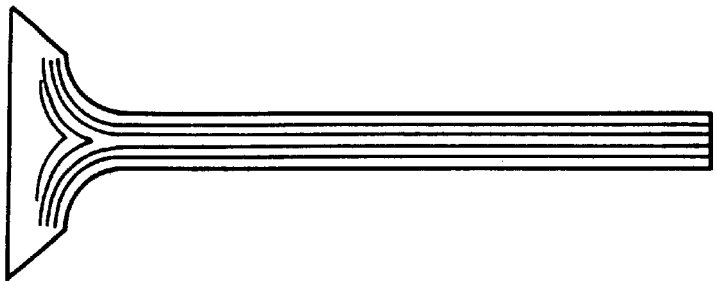
FIG. 4 is a diagram for illustrating the directions of the material flow in the present engine valve.

In the engine valve which was produced through the aforementioned steps, the pores were linearized in the extending direction of the stem, and the titanium boride particles were oriented along the direction. Hence, the engine valve produced in this example was good in terms of the mechanical characteristics. FIG. 4 illustrates the orientations at this moment.

(Evaluation)

Test samples were produced by forging sintered billets. The present forging process was evaluated by measuring the densities and the mechanical characteristics of the test samples.

(Preparation of Test Samples)

A hydride-dehydride titanium powder (under 100 mesh), an Al-40V alloy powder having an average particle diameter of 10 μm, a $TiB_2$ powder having an average particle diameter of 2 μm were weighed so that a predetermined composition was established. The powders were mixed fully. After fully mixing the powders, the mixture powder was compacted with a mold to form a cylinder-shaped green compact having a diameter of 16 mm and a length of 45 mm. At this moment, the compacting pressure was 5 t/cm$^2$. Sample Nos. 11 through 13 were green compacts which were made by mixing the Ti powder and the Al-40V alloy powder. Sample Nos. 14 through 16 were green compacts which were made by mixing the $TiB_2$ powder in addition to the Ti powder and the Al-40V alloy powder.

Thereafter, these cylinder-shaped green compacts were heated at 1,300° C. for 4 hours in an atmosphere whose vacuumness was on the order of $10^{-5}$ Torr. Thus, the green compacts were sintered to obtain sintered billets.

Sintered billets of Sample Nos. 11 and 14 were subjected to machining, and were ground to prepare tensile test specimens and fatigue test specimens.

Sintered billets of Sample Nos. 12 and 15 were subjected to hot coining at a heating temperature of 1,100° C. at a pressure of 10 t/cm$^2$, and thereby they were compacted. Thereafter, they were subjected to the same machining as Sample Nos. 11 and 14 to prepare test specimens.

Sintered billets of Sample Nos. 13 and 16 were subjected to hot extrusion at a heating temperature of 1,100° C. with a cross-sectional area reduction rate of 85%, and thereby they were compacted. Thereafter, they were subjected to the same machining as Sample Nos. 11 and 14 to prepare test specimens.

In addition, as Comparative Example No. 10, test specimens were prepared out of a cast Ti-6Al-4V alloy by grounding.

The respective test specimens were examined for the composition, the relative density, the 0.2% yield strength, the elongation at room temperature and the fatigue strength. The results of the measurements are set forth in Table 2.

TABLE 2

| Identification | Composition (Weight %) | Titanium Boride (Vol. %) | Processing | Relative Density (%) | 0.2% Yield Strength (MPa) | Elongation at R.T. (%) | Fatigue Strength (MPa) |
|---|---|---|---|---|---|---|---|
| Sample No. 11 | Ti—6Al—4V | 0 | Sintering Only | 98 | 820 | 8 | 280 |
| Sample No. 12 | Ti—6Al—4V | 0 | Sintering & Coining | 100 | 880 | 12 | 480 |
| Sample No. 13 | Ti—6Al—4V | 0 | Sintering & Extrusion | 100 | 880 | 15 | 580 |
| Sample No. 14 | Ti—6Al—4V | 10 | Sintering Only | 96 | 1030 | 1 | 310 |
| Sample No. 15 | Ti—6Al—4V | 10 | Sintering & Coining | 100 | 1050 | 2 | 520 |
| Sample No. 16 | Ti—6Al—4V | 10 | Sintering & Extrusion | 100 | 1070 | 5 | 650 |
| Comp. Ex. No. 10 | Ti—6Al—4V | 0 | Casting | 100 | 870 | 14 | 500 |

The measurement of the relative density was carried out by the Archimedes method.

The measurement of the 0.2% yield strength was carried out by measuring the load-displacement diagram.

The measurement of the elongation at room temperature was carried out by observing the gage length, which was marked to the test specimens in advance, before and after the test.

The following are apparent from the results set forth in Table 2. Sample Nos. 12, 13, 15 and 16 exhibited the enlarged 0.2% yield strengths, elongations at room temperature and fatigue strengths by getting full density.

Further, in the case of the samples free from the hard particles (the titanium boride particles), even when the relative densities were 100%, Sample No. 12, which was compacted by coining, exhibited the improved elongation at room temperature and fatigue strength, but the advantageous effects were not sufficient. On the other hand, Sample No. 13, which was extruded, exhibited good characteristics which were equal to or better than those of the cast test specimens of Comparative Example No. 10.

Furthermore, in the case of test specimens in which the titanium boride particles were dispersed, especially Sample No. 14 exhibited the enhanced 0.2% yield strength by extrusion. This advantageous effect is believed to result from the fact that the titanium boride particles were oriented.

Having now fully described the present invention, it will be apparent to one of ordinary skill in the art that many changes and modifications can be made thereto without departing from the spirit or scope of the present invention as set forth herein including the appended claims.

What is claimed is:

1. A process for producing an engine valve, comprising the steps of:

heating a sintered billet;

extruding the heated billet with a part thereof unextruded, thereby forming a stem;

rolling the extruded stem, thereby correcting an axial flexure thereof;

re-heating the sintered billet; and hot upsetting the unextruded part, thereby forming a head.

2. The process according to claim 1, wherein the rolling is carried out immediately after the extrusion.

3. The process according to claim 1, wherein the sintered billet is heated at a temperature falling in the range of from 900 to 1,400° C.

4. The process according to claim 1, wherein the sintered billet includes a titanium-based powder having an average particle diameter of 80 $\mu$m or less.

5. The process according to claim 1, wherein the sintered billet is re-heated at a temperature of from 900 to 1,400° C.

6. An engine valve produced by the production process set forth in claim 2.

7. An engine valve produced by the production process set forth in claim 1, wherein the billet comprises a titanium-based material.

* * * * *